US005273290A

United States Patent [19]

Cole et al.

[11] Patent Number: 5,273,290

[45] Date of Patent: Dec. 28, 1993

[54] GOLF GAME

[75] Inventors: Tony Cole; Mike Tawater, both of Tulsa; Gregory D. Ward, Broken Arrow, all of Okla.

[73] Assignee: MGTee, Inc., Broken Arrow, Okla.

[21] Appl. No.: 909,037

[22] Filed: Jul. 6, 1992

[51] Int. Cl.[5] ..... A63F 3/00

[52] U.S. Cl. ..... 273/277; 273/240; 273/245

[58] Field of Search ..... 273/87 R, 240, 245, 273/277, 244

[56] References Cited

U.S. PATENT DOCUMENTS

| | | | |
|---|---|---|---|
| 1,334,176 | 3/1920 | Seagrave | 273/245 |
| 1,482,330 | 1/1924 | Treboul | 273/245 |
| 1,546,837 | 7/1925 | Johnson | 273/245 |
| 4,042,246 | 8/1977 | Strandgard | 273/245 |

FOREIGN PATENT DOCUMENTS

| | | | |
|---|---|---|---|
| 0016519 | of 1896 | United Kingdom | 273/245 |
| 2198651 | 6/1988 | United Kingdom | 273/245 |

OTHER PUBLICATIONS

"Play Golf", Molanco East, Jun. 1972, 2 pages.

*Primary Examiner*—William Stoll
*Attorney, Agent, or Firm*—Head & Johnson

[57] ABSTRACT

A golf game for one or more players. The golf game includes a playing board having at least one golf course hole depicted thereon, the golf course hole including a tee, obstacles or hazards and a cup. A writing instrument will be used by each player to successively stroke the writing instrument across the golf course hole starting from the tee and continuing to the cup to simulate movement of a golf ball on a course.

5 Claims, 4 Drawing Sheets

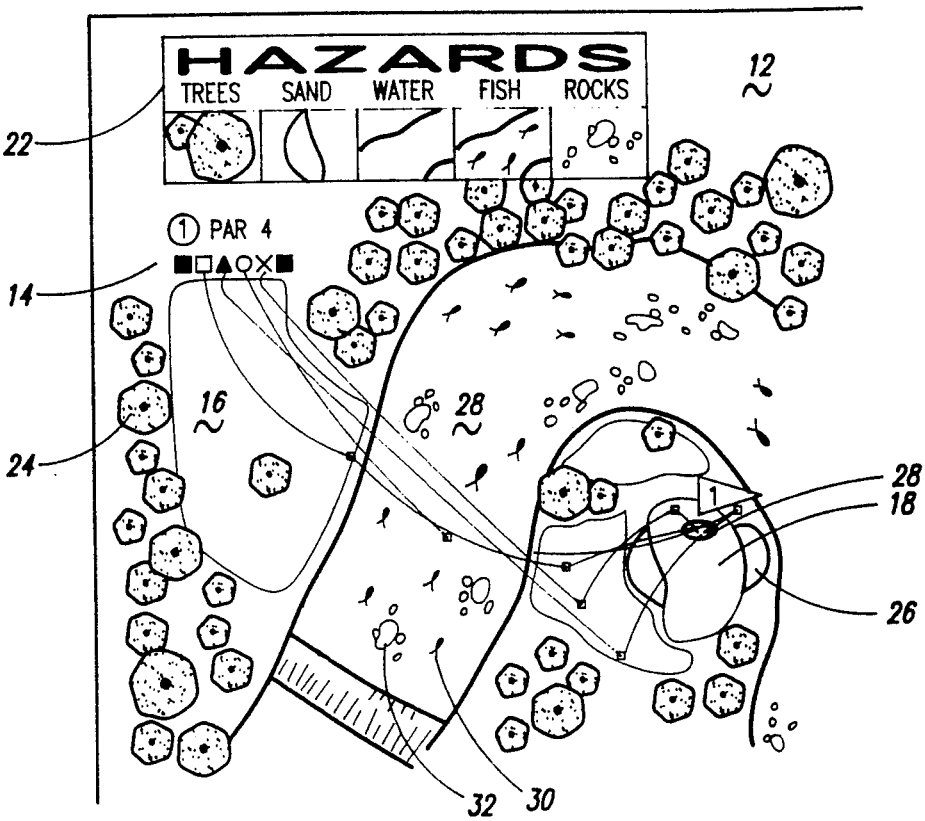
Fig. 2
| Hole No. | × Mark | ▲ Tony | ○ Mike | □ Greg |
|---|---|---|---|---|
| 1 | 7 | 3 | 4 | 3 |
| 2 | 4 | 2 | 4 | 3 |
| 3 | 4 | 3 | 3 | 2 |
Fig. 3
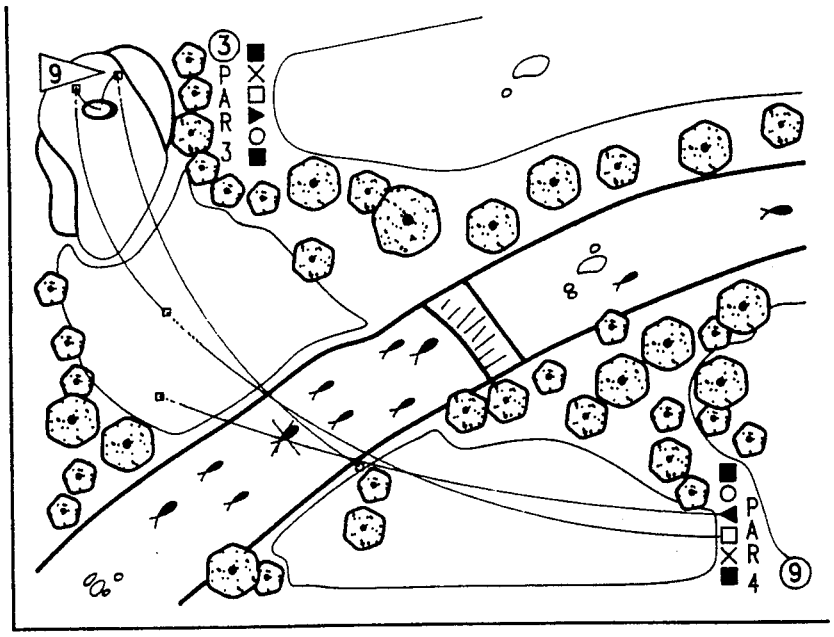
Fig. 6

*Fig. 4*

INSTRUCTIONS

OBJECT OF THE GAME

*The object of the game is to beat someone in a game of golf that might ordinarily hammmer you on a regular golf course. It's also for any player of any handicap to be able to tell anyone who might ask, that he she can play "par golf" without really lying about it!*

WINNER

*The winner is declared after adding up all the strokes. The player with the lowest total stroke counts wins!*

HOW TO PLAY THE GAME

*Begin play by removing the sheet of paper being played from the perforated edge. (This will enable you to move the sheet in any direction to assist you in stroking the pen in your favorite direction.) Decide who tees off first and what order the other players will follow. Select which symbol as yours for the entire game. (Example: The player choosing the circle must always tee off on subsequent holes using the circle as their "tee off" spot.)*

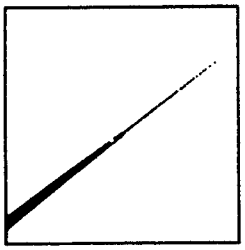

EXAMPLE 1

*First player tees off by using a "stroke of the pen", trying to avoid any "hazards" from an "errant stroke". Next player tees off and so on until all players have had their tee shot. The player farthest from the hole after all the tee shots have been made plays the next shot first. Players continue to make strokes until they have "holed out". Shots are added up for each hole. Low scorer for each hole has the honors for the next hole and tees off first. Continue until all holes have been completed.*

GENERAL RULES

*Regular golf rules apply, except for the following definitions.*

DEFINITIONS

*Stroke of the pen – The "stroke of the pen" shall not be stroked slow enough to avoid any "hazard" lines. The stroke of the pen must be one quick, fluid motion, coming off of the paper at the end of the stroke. If the pen is stroked correctly, the pen line will thin out at the end of the stroke as it comes off of the paper. (See example #1). Each "stroke the pen" is considered one shot or one putt.*

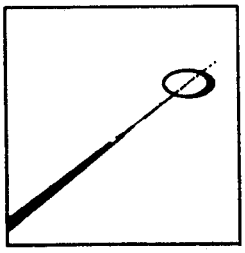

EXAMPLE 2

*Putt – After reaching the green, any following pen stroke toward the cup is considered a putt. If the pen line does not reach the cup line or runs through the entire cup, past the other side of the cup line, (even by the tiniest of micro-fractions) (See example #2) it is considered a missed putt, and must be stroked again until it enters the cup circle or just touches the cup circle line. (Even by the tiniest micro-fractions).*

*Fig. 5*

*Holed-out* – *Successfully completing the hole.*

*Errant Stroke* – *Any stroke of the pen that touches (even by the smallest of margins) any tree of other hazard line, is first of all an errant stroke and should be improved upon with enough practice. The errant stroke should be restroked (with a one stroke penalty added) from the point of contact with the tree or other inland hazard.*

*Hazards* – *Water*, sand, trees, flying fish, rocks or anything else that might show up in the hazards box at the top edge of each sheet is bad news. That means stay away! Don't go near them!*

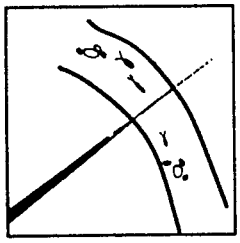

EXAMPLE 3

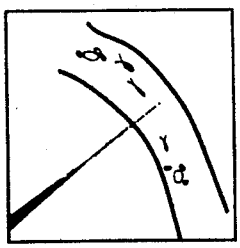

EXAMPLE 4

*Crossing a water hazard line is not an errant stroke if the pen line connects with the land on the other side of the water. See example #3. If the pen line does not connect with any other land after having touched a water hazard line, then it is considered an errant stroke, with penalty added, and must be restroked from the point of the land last touched by the pen line. See example #4. A flying fish hazzard touched by the pen line is also considered an errant stroke (and a dead fish) and must be restroked from the point of land last touched by the pen line. Oh... and add another penalty stroke. Anyway, the dead fish is no longer there and may be restroked through on subsequent strokes by the same player or other subsequent players. Rocks don't die, therefore, may not be restroked through without another penalty stroked being assessed each time one is touched by the pen line and trying again from the point of land last touched by the pen line. This next item may not set well with some folks, but we need to address the subject of SAND. We all know in real golf, that a good shot might go over the sand and a poor shot might not. Well ... in this game ... sand is a hazzard! Remember ... don't go near them! Stay away! Pen lines that touch a sand hazzard line are considered errant strokes. (It costs you another stroke). So if it was an errant stroke, it probably went in the sand and you probably would have duffed it on the way out with your next shot anway. (See ... there's the extra stroke.) Sorry ... but we make the rules, and in this game, well ... sand is just no good. Just stroke the pen around it.

*P.S.* – *One last word about errant stroks that could result in a game deciding penalty stoke. Remember, golf is a game of honor, and all potentially errant stroks should be reviewed by all players involved, with the naked eye, (no magnifying glasses allowed) to determine the final decision as to whether or not it is in fact an errant stroke. Majority rules! Let's be sports about it! ... Enjoy!*

GOLF GAME

BACKGROUND OF THE INVENTION

1. Field of the Invention

The present invention is directed to a game which simulates a golf game. In particular, the present invention is directed to a game wherein a playing board contains a depiction of a golf course and a writing instrument is used to produce written strokes which simulate movement of a golf ball on a golf course.

2. Prior Art

Various games have been produced in the past which simulate a game of golf. Some of these contain depictions of golf courses on a playing board.

Strandgard (U.S. Pat. No. 4,042,246) discloses a golf board game having a board on which is located a tee. Starting positions on the tee correspond to a plurality of paths which join one another at a point of intersection representing a cup. Dice or chance means indicate movement of tokens on the board.

Barbiaux et al. (U.S. Pat. No. 5,000,460) discloses a golf board game wherein each player designates a club which he desires to use after placing of a direction indicator on the fairway. A roll of a pair of dice establishes the distance achieved and a roll of a third die bears indicia in order to indicate direction of a shot.

Lacy (U.S. Pat. No. 4,380,338) discloses a board depicting a golf course wherein cards and dice control and direct movement around the board.

None of the prior art discloses a board game wherein the stroke of a writing instrument on the board produces a written stroke that simulates movement of a golf ball around a golf course.

Accordingly, it is an object and purpose of the present invention to provide a golf game wherein a stroke or strokes of a writing instrument upon a playing board simulates movement of a golf ball on a golf course.

It is a further object and purpose of the present invention to provide a golf game wherein a writing instrument is used by each player to successively stroke the writing instrument across the golf course hole.

SUMMARY OF THE INVENTION

The present invention provides a golf game for one or more players which simulates an actual game of golf.

The game includes a playing board which contains a flat surface. A course containing a number of holes is laid out on the playing board. Each golf course hole starts out from a tee area. The tee area may include a number of symbols, one of which would be adopted by each player.

A writing instrument will be used by each player to successively stroke the tip of the writing instrument across the golf course hole beginning or starting from the tee area and continuing with successive strokes across the golf course hole up to the cup.

In order to play the game, an order of play will be determined by the players. The first player who has the honors will take a stroke first. The stroke will start with the tip of the writing instrument on one of the symbols. A quick, sharp stroke of the pen or writing instrument by the hand will be made. Each stroke will start from a starting point with the tip of the writing instrument resting on the board and terminate with the tip of the writing instrument off the board. The player whose stroke ends farthest from the cup after all of the tee shots have been made, plays the next shot first. In each instance, the second stroke will begin from a point at the terminating point of the previous stroke. Each player continues in this fashion until they have holed out by stroking up to the cup.

The score may be recorded and retained on a score card showing the number of strokes for each player for each hole.

BRIEF DESCRIPTION OF THE DRAWINGS

FIG. 2 is an enlarged view of a portion of the playing board seen in FIG. 1; and FIG. 3 is a scoring card which is used as part of the golf game of the present invention.

FIG. 4 shows a pen line becoming thinner at the end of the stroke.

FIG. 5 shows examples of an errant stroke and a successful stroke.

FIG. 6 depicts another round of play.

DETAILED DESCRIPTION OF THE PREFERRED EMBODIMENT

Figure 1:
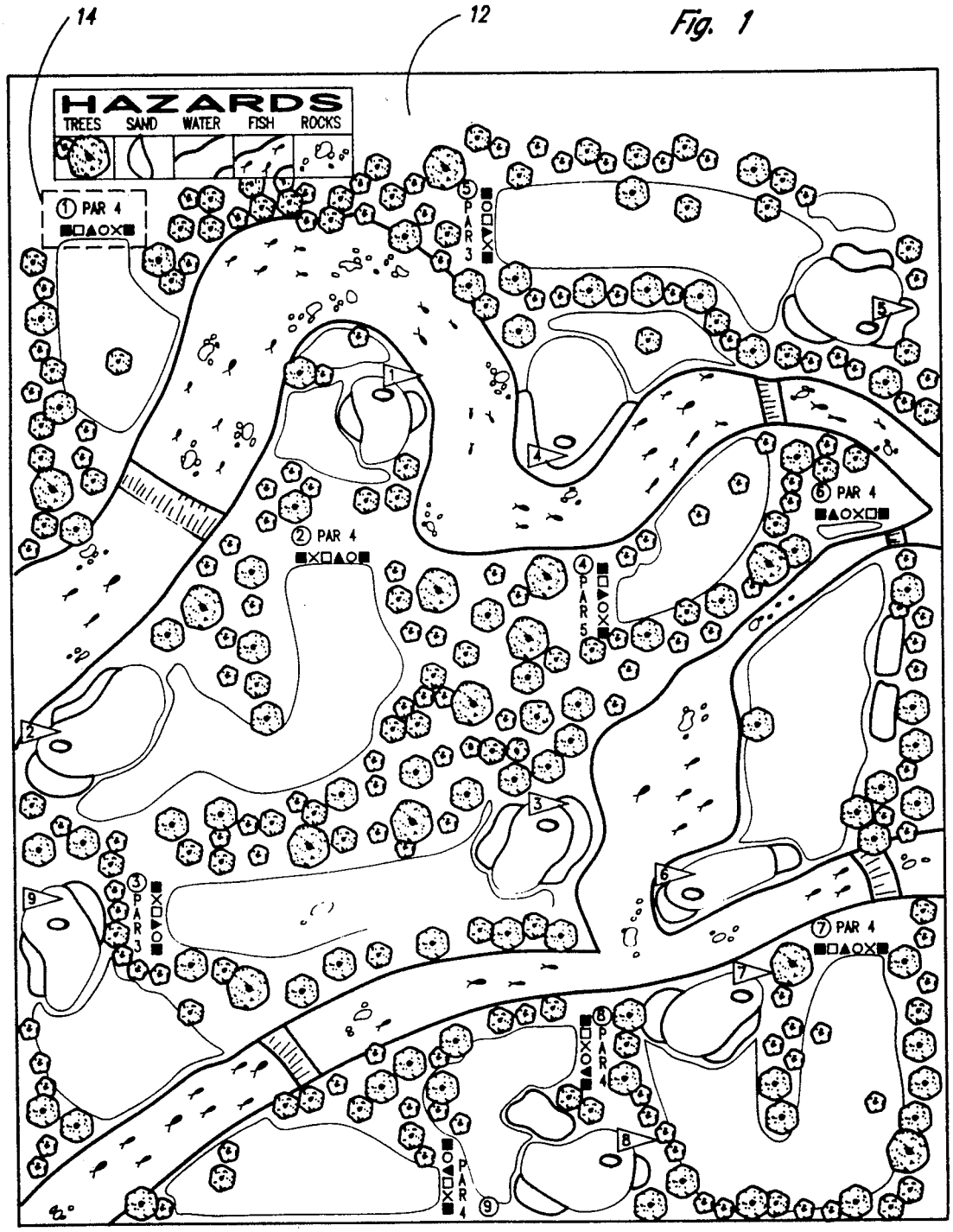
FIG. 1 is an example of a playing board used as a part of the golf game of the present invention.

Referring to the drawings in detail, FIG. 1 illustrates a playing board 12 which is used as a part of the game. The playing board will contain a flat surface and may be constructed of various materials such as paper or the like. The game may be packaged with a number of playing boards so that a board is discarded after use.

Printed on the playing board is at least one golf course hole. In the present embodiment, a nine hole course is laid out on the playing board 12. It will be understood that the game may entail 18 holes or some other number. Each golf course hole starts from a tee area 14 such as shown within the dashed lines. The tee area or teeing ground is the starting place for the hole to be played. The tee area 14 may include a number of symbols such as those shown on the playing board. In the present embodiment, four symbols are utilized—square, triangle, circle and "x". One symbol would be adopted by each player so that the game may be readily be played with up to four players. Each player will continue to tee off from that symbol during the entire game.

As an example, an enlarged view of the first hole is seen in FIG. 2 and includes a tee area 14, a fairway 16, a number of obstacles or hazards, a green 18 and a cup 20. The cup is depicted by a circle or oval.

The obstacles or hazards may take a variety of forms. The hazards are depicted in the box 22 seen in FIG. 2. In the present embodiment, trees 24, sand or sand traps 26, water 28, fish 30 and rocks 32 are provided.

A writing instrument (not shown) will be used by each player to successively stroke the tip of the writing instrument across the golf course hole beginning or starting from the tee area 14 and continuing with successive strokes across the course hole up to the cup 20. The written strokes will simulate movement of a golf ball over a golf course.

It has been found that a pen used as a writing instrument will be highly effective. Pencils have been found to somewhat less effective since the width of the pencil line increases as play continues. Each written stroke must be a single, quick and fluid movement of the hand from a starting point with the tip of the writing instrument resting on the board and terminating with the tip of the writing instrument off the board. It has been found that only a minimum amount of practice is required to become adept at the required hand movement.

The play of the golf game may be observed from a round of play shown on the first hole.

The enlarged view in FIG. 2 illustrates a round of play. Initially an order of play will be determined by the players themselves. The player who is entitled to play first is said to have the "honor". In this case, the "□" player has stroked first and has taken a stroke from the tee area 14 up to the edge of the water 28. The stroke will start with the tip of the writing instrument on the square symbol (□). A quick sharp stroke of the pen by the hand will be made.

The "Δ" player proceeds next. His stroke starts on the triangle symbols (Δ) and continues across the fairway 16 and across the water. The "○" player ended in the water hazard and, accordingly, suffers a penalty and will start from the far end of the water hazard. Finally, the "X" player takes his or her stroke.

The play will continue in this matter. The player whose stroke ended farthest from the cup 20 after all of the tee shots have been made, plays the next shot first. In each instance, the second stroke will begin from a point at the terminating point of the previous stroke. In order to address the next stroke, it may be desirable to draw a small symbol, such as the square, around the terminating point of the previous stroke. The players continue in this fashion until they have holed out by stroking up to the cup 20. The number of strokes is then added up and the score is recorded.

The low score for each hole has the honors for the next hole and tees off first. Play will continue in this matter until all of the holes have been completed.

The stroke of the pen on the playing board by a player must be a quick fluid motion and should not be slow enough so as to deliberately avoid any hazards.

The stroke of the pen by the player should come off of the paper at the end of the stroke. If the writing instrument is stroked properly, the pen line will thin out at the end of the stroke as it comes off of the paper. As an example, see the enlarged view in FIG. 4.

After reaching the green 18, any stroke thereafter toward the cup 20 is considered a putt. If the written putt stroke does not reach the cup or if the written stroke runs through the entire cup and on to the other side of the cup line, it is considered a missed putt and must be stroked again until the stroke terminates within the cup circle or just touches the cup circle line.

Any written stroke that touches any of the hazards or obstacles should be restroked with a one stroke penalty added from the point of contact with the tree or other hazard or obstacle. The only exception to this rule is when crossing a water hazard. Crossing a water hazard line is not an errant stroke if the pen line connects with the land on the other side of the water. As an example, see FIG. 5. If the pen line does not connect with any other land after having touched a water hazard line, then it is considered an errant stroke, with a penalty added, and must be restroked from the point of land last touched by the written stroke line. A fish or flying fish hazard 30 which is touched by the pen is also considered an errant stroke and must be restroked from the point of land last touched by the pen line. Once a fish has been touched it is considered "dead" and may be stroked through on subsequent strokes by the same player or other subsequent players. Any stroke that touches or goes through a sand hazard is considered an errant stroke with penalty stroke added. Other hazards such as loose impediments or artificial obstructions might be devised without deviating from the spirit of the game.

In the event of a question concerning an errant stroke, all of the players will review the stroke on the board 12. No magnifying glass or other aid is allowed. The majority decision is final.

Various types of play may be conducted. For instance, in a singles match, one player plays against another. In a threesome match, one plays against two and each side starts from one symbol and strokes therefrom. In a foursome match, two play against two and each side starts from one symbol and strokes therefrom.

In general, the United States Golf Association rules will apply except where they are modified by the rules of the present game. It will be appreciated that variations on this game may be devised by the players themselves.

FIG. 3 illustrates a score card showing the scoring for the game. The first three holes of the match have been scored showing the number of strokes for each player for each hole.

Another round of play may be observed from the enlarged view seen in FIG. 6. Two players, the □ and Δ, have played the par 4 Ninth hole. The □ player has the honors and has shot first, across the water hazard and onto the fairway. The Δ player's first shot hits a fish, resulting in a penalty stroke with the next shot across the water to the green. The fourth shot is a putt into the cup. The □ player's second shot is onto the green with the third shot being a putt into the cup.

Whereas, the present invention has been described in relation to the drawings attached hereto, it should be understood that other and further modifications, apart from those shown or suggested herein, may be made within the spirit and scope of this invention.

What is claimed is:

1. A method of playing a golf game having a playing board with at least one golf course hole depicted thereon for one or more players including a tee, obstacles or hazards, and a cup, which comprises:

holding a writing instrument on a depiction of a tee on said playing board; and successively stroking said writing instrument across said golf course hole, each said stroke consisting of a single, quick, fluid motion of said writing instrument by the hand of said player from in a tapered line at the end of the stroke as the writing instrument comes off of the board starting from said tee and continuing to said cup to simulate movement of a golf ball on a course.

2. A method of playing a golf game as set forth in claim 1 including recording the number of strokes required by each player for each course hole one a score card.

3. A method of playing a golf game as set forth in claim 2 wherein said obstacles or hazards include depictions of sand traps, rocks, trees, water and fish and including assessing a penalty stroke for each stroke crossing each said rock, tree, sand trap or fish.

4. A method of playing a golf game as set forth in claim 1 including assessing a penalty stroke for each stroke that ends in any water.

5. A method of playing a golf game as set forth in claim 2 including starting each said stroke at said tee at the beginning of a course and starting each subsequent stroke at the end of the previous stroke.

* * * * *